US008536105B2

(12) United States Patent
Dooley et al.

(10) Patent No.: US 8,536,105 B2
(45) Date of Patent: Sep. 17, 2013

(54) METHOD OF CLEANING CONTAMINATED SURFACES

(75) Inventors: Joseph B. Dooley, Kingston, TN (US); Jeffrey G. Hubrig, Knoxville, TN (US)

(73) Assignee: Innovation Services, Inc., Knoxville, TN (US)

( * ) Notice: Subject to any disclaimer, the term of this patent is extended or adjusted under 35 U.S.C. 154(b) by 34 days.

(21) Appl. No.: 12/795,682

(22) Filed: Jun. 8, 2010

(65) Prior Publication Data

US 2011/0301069 A1 Dec. 8, 2011

(51) Int. Cl.
*C11D 1/66* (2006.01)

(52) U.S. Cl.
USPC ..... 510/161; 134/26

(58) Field of Classification Search
USPC ..... 510/161; 134/26
See application file for complete search history.

(56) References Cited

U.S. PATENT DOCUMENTS

| | | | | |
|---|---|---|---|---|
| 4,554,099 | A * | 11/1985 | Clarke | 510/416 |
| 5,320,783 | A * | 6/1994 | Marin et al. | 510/403 |
| 6,846,793 | B1 | 1/2005 | Griese | |
| 7,198,680 | B1 * | 4/2007 | Dooley et al. | 134/26 |
| 7,241,729 | B2 * | 7/2007 | Sivik et al. | 510/475 |
| 7,384,902 | B2 * | 6/2008 | Chernin et al. | 510/264 |
| 7,540,926 | B2 * | 6/2009 | Dooley et al. | 134/26 |
| 2002/0151448 | A1 * | 10/2002 | Mitra et al. | 510/238 |
| 2003/0004312 | A1 | 1/2003 | Prusiner et al. | |
| 2008/0023030 | A1 | 1/2008 | Dooley et al. | |

FOREIGN PATENT DOCUMENTS

| | | |
|---|---|---|
| GB | 2204321 | 11/1988 |
| GB | 2242686 | 10/1991 |
| GB | 2427614 | 1/2007 |
| WO | 97/32968 | 9/1997 |

* cited by examiner

*Primary Examiner* — Mark Eashoo
*Assistant Examiner* — M. Reza Asdjodi
(74) *Attorney, Agent, or Firm* — Luedeka Neely Group, P.C.

(57) ABSTRACT

A medical instrument cleaning concentrate and method for cleaning medical equipment. The concentrate contains an active ingredient consisting essentially of (i) a biofilm permeation agent and (ii) a nonionic alkoxylated alcohol surfactant having an HLB ranging from about 5 to about 8, wherein a ratio of (i) to (ii) in the concentrate ranges from about 2:1 to about 4:1.

9 Claims, No Drawings

METHOD OF CLEANING CONTAMINATED SURFACES

FIELD OF THE DISCLOSURE

The present disclosure is generally directed toward concentrates and liquid solutions for cleaning surgical instruments. More particularly, the disclosed embodiments are directed to highly effective concentrates and solutions for cleaning surfaces contaminated with biological materials, such as blood, fat, tissue, bone, fecal materials, and the like.

BACKGROUND AND SUMMARY

After a surgical or other medical procedure, medical instruments used in the surgery or procedure are wiped to remove large or loosely held bone, tissue and/or blood and washed to remove any gross blood and/or tissue residuals. The instruments are then placed in a surgical tray and loaded into a case or cart for transport to a sterile processing department for further cleaning and sterilization. All of the instruments are manually inspected and hand washed in wash sinks before the surgical trays are placed in automatic dishwashers for continued processing through the department. Conventional cleaning products used for washing surgical instruments typically include enzyme solutions and preparations that are provided in concentrated form and are added to wash water for surgical instruments.

However, the enzyme solutions that are commercially available have several disadvantages. For example, the enzyme solutions typically have a relatively short shelf life that may be adversely affected by storage temperatures that may destroy or greatly reduce the effectiveness of the enzyme solutions before the solutions can be used. During use of the enzyme solutions, it is necessary to control the water temperature so that the effectiveness of the enzymes is not reduced. Directions for use of the enzymes suggest relatively long soak times for the enzymes to work on the organic materials on the instruments. However, throughput requirements in the sterile processing department may result in soak times that may not be sufficient for the enzyme solutions to effectively clean the instruments. The enzyme solutions may also contain other active ingredients, such as surfactants, pH buffers, and the like, that are chemically compatible with the enzymes in the solutions. Such other active ingredients may make it difficult to wash and rinse the instruments in the wash sinks once the enzymes have interacted with materials on the surface of the instruments.

Accordingly, what is needed is a cleaning solution or concentrate that does not exhibit the disadvantages of the enzyme solutions in current commercial use, but is as effective or more effective in cleaning the medical instruments in the sterile processing department of a hospital or medical facility. The cleaning solutions should also be relatively environmentally friendly so that disposal of the solutions does not create additional hazards.

With regard to the foregoing needs, the disclosure provides a medical instrument cleaning concentrate and method for cleaning medical equipment. The concentrate contains an active ingredient consisting essentially of (i) a biofilm permeation agent and (ii) a nonionic alkoxylated alcohol surfactant having an HLB ranging from about 5 to about 8, wherein a ratio of (i) to (ii) in the concentrate ranges from about 2:1 to about 5:1.

Another embodiment of the disclosure provides a method for cleaning contaminated surfaces of medical equipment. The method includes rinsing surfaces of the equipment with water to remove water soluble contaminants and waste material. The rinsed surfaces of the equipment are then washed with an active cleaning ingredient consisting essentially of (i) a biofilm permeation agent and (ii) a nonionic alkoxylated alcohol surfactant having an HLB ranging from about 5 to about 8, wherein a ratio of (i) to (ii) in the active cleaning ingredient ranges from about 2:1 to about 5:1. Next, the contacted surfaces are rinsed to remove traces of the active cleaning ingredient from the surfaces.

An advantage of the compositions and methods described herein is that the cleaning compositions are more stable than conventional enzyme solutions and thus have an extended shelf-life. Unlike the enzyme solutions, the compositions described herein may be rinsed substantially completely from the cleaned surfaces without leaving residual cleaning agents on the surfaces of the equipment. The cleaning composition described herein may rinse more rapidly from the surface of the equipment then equipment treated with the conventional enzyme cleaning solutions. Reattachment of lipid complexes to the equipment surfaces cleaned with the cleaning compositions described herein is inhibited by the cleaning compositions. Other benefits and advantages of the cleaning compositions of the present disclosure may be evident from the following detailed description of exemplary embodiments.

DETAILED DESCRIPTION OF EXEMPLARY EMBODIMENTS

Important considerations for any medical equipment cleaning solution is the ability of the solution to efficiently clean the equipment, substantially rinse free from the equipment, and be compatible with the substrate materials of the medical equipment. Conventional enzyme solutions used for cleaning such equipment typically have a combination of ingredients that preserve the activity of the enzymes but one or more of such ingredients may not be compatible with the substrate materials of the equipment and/or may cause the cleaning solutions to leave a residue on the equipment. Solutions that "substantially rinse free" from the equipment, as used herein, means solutions that leave no visually detectable residue on the equipment.

Bio-films are contaminants that attach to surfaces of medical equipment, for example, surgical instruments and devices. Such films may include lipophilic substances such as fatty organic compounds. Residues from surgical operations include components such as blood, fat, tissue, bone, fecal materials, and surgical rinse solutions having lipophilic components. Such lipophilic substances typically have an affinity for metal and polymeric surfaces and may provide a medium for attachment of protein molecules and bacteria to such surfaces. Once attached to the surface of such equipment, cleaning of the equipment surfaces is extremely difficult and time consuming. However, the compositions described herein may be effective to provide both effective cleaning of contaminated surfaces and a reduction in soaking time for cleaning the contaminated surfaces.

A first component of the cleaning solutions disclosed herein is a bio-film permeation agent. Because the substance is effective to penetrate the bio-film to the bio-film/surface interface, the substance is referred to herein as a "permeation agent." Suitable permeation agents may be selected from alkyl ether sulfates. Alkyl ether sulfates that may be used, include but are not limited to, sodium coconut alkyl sulfate, potassium coconut alkyl sulfate, potassium lauryl sulfate, sodium lauryl sulfate, sodium yellow fatty alcohol ether sulfate, tallow fatty alcohol sulfate (25 ethylene oxide), tallow fatty ether sulfate, sodium dodecyl benzene sulfonate, sodium stearyl sulfate, sodium palmityl sulfate, sodium decyl sulfate, sodium myristyl sulfate, sodium dodecyl sulfate, potassium dodecyl benzene sulfonate, potassium stearyl sulfate, potassium palmityl sulfate, potassium decyl sulfate, potassium myristyl sulfate, potassium dodecyl sulfate, and mixtures thereof.

Other examples of permeation agents that may be used are sodium lauryl ether sulfate, ammonium lauryl sulfate, ammonium lauryl ether sulfate, sophorose biosurfactant, sodium lauroyl sarcosinate, triethanolamine lauroyl-L-glutamate, sodium myristyl sarcosinate, potassium laurate, sodium dodecane sulfonates, and sodium lauryl ethoxysulfate.

Without desiring to be bound by theoretical considerations, it is believed that the permeation agent may react with the bio-film layer through absorption and permeation to induce molecular cleavage within the bio-film structure so as to initiate adhesive failure at a boundary layer between the bio-film structure and equipment substrate surface. Once adhesive failure at the boundary layer is induced by the permeation agent, the surfactant component of the cleaning concentrate enables carrying away the bio-film from the substrate surfaces into the bulk solution.

A particularly useful permeation agent for cleaning medical equipment described herein is sodium lauryl sulfate. Sodium lauryl sulfate is often referred to as an anionic surfactant. However, in the compositions described herein, sodium lauryl sulfate has more of a detergent effect. The sodium lauryl sulfate is effective to promote solubilization and mobilization of protein and lipid structures, thereby preventing adhesion of the bio-film to the equipment surfaces. Another advantage of the sodium lauryl sulfate is that it may act as a biocidal agent thereby destroying or inhibiting the growth of odor causing bacteria on the equipment. The amount of permeation agent in the cleaning concentrate compositions described herein may range from about 50 to about 90 percent by weight based on a total weight of the composition. A typical cleaning concentrate may contain from about 70 to about 80 percent by weight of the permeation agent.

A second component of the cleaning concentrate composition described herein is a nonionic surfactant having a hydrophilic: lipophilic balance (HLB) value of from about 5 to about 8. The "hydrophilic: lipophilic balance", or "HLB" value is used as a measure of the relative affinities of the surfactants for water and lipophilic or "oily" substances respectively and correlates with their effectiveness as emulsifiers. HLB values may be calculated for alcohol ethoxylates since it is one fifth of the weight percent of ethylene oxide based on the total mole weight. Other surfactants may be assigned equivalent values by applying more complicated formulae or by measuring their relative affinity for water and oil. An HLB value of 20 represents a completely water soluble, oil insoluble surfactant, while an HLB value of 0 represents a completely oil soluble, and water insoluble surfactant.

The nonionic surfactant which may be used may be selected from linear and branched alkoxylated alcohols. Still further illustrative examples of nonionic surfactants include primary and secondary linear and branched alcohol ethoxylates, such as those based on $C_6$ to $C_{18}$ alcohols which further include an average of from 2 to 80 moles of ethoxylation per mol of alcohol. Examples include the linear and fatty alcohol ethoxylates from Clariant Corp., Charlotte, N.C. under the trade name GENAPOL.

Further examples of useful nonionic surfactants include secondary $C_{12}$ to $C_{15}$ alcohol ethoxylates, including those which have from about 3 to about 10 moles of ethoxylation. Such are available from Dow Chemical Co. of Midland, Mich., under the trade name TERGITOL particularly those in the TERGITOL "L" series such as TERGITOL L-62. Further exemplary nonionic surfactants include linear primary $C_{11}$ to $C_{15}$ alcohol ethoxylates, including those which have from about 3 to about 10 moles of ethoxylation. Such are available from Tomah Products, Inc., Milton, Wis., under the trade name TOMADOL, such as: TOMADOL 23-3 (linear alcohol with 2.9 moles (average) of ethylene oxide); and TOMADOL 25-3 linear alcohol with 2.8 moles (average) of ethylene oxide); TOMADOL L80 (alcohol with 40 wt. % ethylene oxide).

Further examples of suitable nonionic surfactants for use as the at least one nonionic surfactant include alkyl glucosides, alkyl polyglucosides and mixtures thereof. Alkyl glucosides and alkyl polyglucosides can be broadly defined as condensation products of long chain alcohols, e.g., $C_8$ to $C_{30}$ alcohols, with sugars or starches or sugar or starch polymers i.e., glycosides or polyglycosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like. Commercially available examples of these surfactants include decyl polyglucoside (available from Cognis, Cincinnati, Ohio) under the trade name APG.

The alkoxylated alcohols include ethoxylated, propoxylated, and ethoxylated and propoxylated $C_5$-$C_{20}$ alcohols, with about 1-5 moles of ethylene oxide, or about 1-5 moles of propylene oxide, or 1-5 moles of ethylene oxide and 1-5 moles or propylene oxide, respectively, per mole of alcohol. There are a wide variety of products from numerous manufacturers, such as a linear $C_{12}$-$C_{15}$ alcohol ethoxylate with 3 moles of ethylene oxide ("EO") per mole of alcohol, HLB of 7.8, a linear $C_9$-$C_{11}$ alcohol ethoxylate with 2.5 moles of EO; a $C_{12}$-$C_{14}$ ethoxylated alcohol with 3 moles of EO; a $C_{10}$-$C_{12}$ ethoxylated alcohol with 3 moles of EO; and a $C_{12}$-$C_{15}$ ethoxylated alcohol with 3 moles of EO. Secondary ethoxylated alcohols include a $C_{11}$-$C_{15}$ secondary ethoxylated alcohol, with 3 moles of EO. Branched surfactants include tridecyl ethers, such as a tridecyl ether with 3 moles of EO.

Other non-ionic surfactants which may be used include: fatty acid monoalkylolamide ethoxylates, fatty amine alkoxylates and fatty acid glyceryl ester ethoxylates. Other nonionic compounds suitable for inclusion in compositions of the disclosed embodiments include mixed ethylene oxide propylene oxide block copolymers, low relative molecular mass polyethylene glycols, ethylene glycol monoesters, amine oxides and alkyl polyglycosides, alkyl sugar esters including alkyl sucrose esters and alkyl oligosaccharide ester, alkyl capped polyvinyl alcohol and alkyl capped polyvinyl pyrrolidone.

Of the foregoing nonionic surfactants, an ethoxylated linear or branched alcohol nonionic surfactant having an HLB value ranging from about 5 to about 8 may provide the most suitable release agent for removing the biofilm permeation agent from the medical equipment. Accordingly, the cleaning concentrate may contain from about 15 to about 30 percent by weight of the surfactant.

Without desiring to be bound by theory, it is believed that because the surfactant having an HLB value ranging from about 5 to about 8 is substantially water soluble, the surfactant enables the biofilm permeation agent to be easily released from the equipment surface by a simple water rinse. Accordingly, the cleaning solution described herein may leave substantially no visible residue on the cleaned equipment once rinsed.

A major component of cleaning solutions described herein is an aqueous solvent, such as water. Medical equipment cleaning solutions described herein typically contain a major amount of the solvent which may be provided by potable water. Solubilizing agents may be included in the solvent to aid in solubilizing the components of the cleaning concentrate composition. For example, concentrates containing the surfactants and permeation agent may require dispersing or solubilizing agents to provide uniform solution concentrates that may be diluted upon use to provide the cleaning solutions. Such solubilizing or dispersing agent may include, but are not limited to, alcohols, glycols, glycerines, and the like. The amount of solubilizing or dispersing agent in the compositions described herein may range from about 2 to about 10 percent by weight based on the total weight of the composition.

The major components of the compositions described herein may promote a pH that is slightly acidic to neutral. However, the compositions may be more effective for the cleaning applications described herein if the compositions are slightly alkaline. According, a pH adjustment agent may be added to the composition to provide a pH in the range of from about 6.5 to about 10.0. A more desirable pH of the compositions described herein may range from about 8.5 to about 9.5.

A suitable pH adjustment agent may be selected from weak bases such as, ammonium hydroxide, 2-aminopropanoic acid, ammonia, magnesium hydroxide, methylamine, ethylamine, dimethylamine, trimethylamine, pyridine, glycine, hydrazine, and the like. Accordingly, compositions as describe herein may include from about 0.01 to about 1.0 percent by weight of the pH adjustment agent based on a total weight of the composition. Cleaning solution concentrates may contain from about 0.01 to about 0.5 weight percent of the pH adjustment agent.

Another optional component that may be present in the compositions described herein is an antifoam agent. Suitable antifoam agents include silicone and siloxane polymers. A particularly suitable antifoam agent is a polydimethylsiloxane composition. A minor amount of antifoam agent may be used in the compositions described herein to reduce foaming tendencies of the compositions. Accordingly, the cleaning solutions may contain from about 0.005 to about 0.05 percent by weight of the antifoam agent.

Depending on the particular application, the cleaning solutions described herein may be modified to include other ingredients for specific applications. For example, dyes and fragrances, and the like may be included to provide additional functionality. One particularly useful ingredient is a blue dye that unexpectedly provides optical clarity to the wash water. An advantage of the use of one drop of blue dye in 60 liters of water is that sharp edges of the surgical equipment being cleaned can more readily be seen thereby avoiding injury to the cleaning personnel. Such optical clarity is typically not experienced with conventional enzymatic solutions used to wash the equipment.

A particularly useful application of cleaning concentrate compositions described herein is for cleaning surgical instruments used in operating rooms. Such surgical equipment typically has surfaces that have an affinity for the bio-films described above. Such instruments may be made of metal and/or polymeric materials such as acrylics, polypropylene, polyethylene, polystyrene, and the like. After an operation, the surgical instruments are collected wiped by hand and placed in a cleaning tray where the instruments are rinsed to remove gross size particles, blood, bone, and the like from the instruments. Next, the instruments are placed in a wash basin containing from about 6 to about 8 milliliters of the active cleaning ingredient per about 0.5 to about 2 liters of water. After contacting the instruments in the wash basin with the cleaning concentrate described herein for a period of time ranging from about 10 seconds to about 3 minutes, typically from 15 seconds to 1 minute, the instruments may be rinsed to remove traces of the cleaning agent from the instruments before they are moved to an automatic dishwasher for continued processing. For comparison purposes, the enzymatic solutions require from about 2 to about 5 minutes at a temperature of no more than about 54° C., while the cleaning concentrate of the disclosed embodiments is not temperature sensitive and thus can be used at any suitable cleaning temperature. After washing in the dishwashing device the instruments are inspected, wrapped or bagged and sterilized. The sterilized instruments are then ready for the next surgical procedure.

In an alternative embodiment, the cleaning concentrate may be sprayed onto the instruments in the operating room as a presoak foam cleaning agent prior to moving the instruments to the wash basin. Use of the foam cleaning agent may have several advantages. For example, the foam cleaning agent may prevent the drying of blood and other residual biological materials on the instruments so that a need to scrub the instruments in the wash sink is reduced or eliminated. Another advantage of a foam cleaning agent is that it may inhibit the formation of odor causing bacterial on the instruments prior to washing the instruments. The foam contacted instruments may be placed in the wash basin that contains additional cleaning agent, if desired, to further remove traces of biological materials from the instruments.

Methods for providing a foam cleaning agent as described above may include, but are not limited to, controlling the orifice size of a foam spray container, controlling the pressure in the container using an inert compressed gas such as air, carbon dioxide, butane, propane, nitrogen, argon and the like, and/or including an additional foaming agent in the foam cleaning agent. Desirably, the foam cleaning agent may be made without additional foaming agents as the permeation agent may act as a foaming agent itself. Likewise, the foam cleaning agent may be devoid of the antifoam agent used in the cleaning solution described above. It is desirable that the foaming agent be devoid of materials that form aerosol droplets.

It is contemplated, and will be apparent to those skilled in the art from the preceding description that modifications and/or changes may be made in the embodiments of the disclosure. Accordingly, it is expressly intended that the foregoing description is illustrative of exemplary embodiments only, not limiting thereto, and that the true spirit and scope of the present disclosure be determined by reference to the appended claims.

The invention claimed is:

1. A medical instrument cleaning concentrate having an active ingredient consisting essentially of (i) a biofilm permeation agent selected from the group consisting of sodium lauryl sulfate, sodium lauryl ether sulfate, ammonium lauryl sulfate, ammonium lauryl ether sulfate, sophorose biosurfactant, sodium lauroyl sarcosinate, triethanolamine lauroyl-L-glutamate, sodium myristyl sarcosinate, sodium dodecyl sulfate, potassium laurate, sodium dodecane sulfonate, and sodium lauryl ethoxysulfate and (ii) a single nonionic alkoxylated alcohol surfactant having an HLB ranging from about 5 to less than about 8, wherein a ratio of (i) to (ii) in the concentrate ranges from about 2:1 to about 5:1, and wherein a wash solution containing from about 6 to about 8 milliliters of the concentrate per from about 0.5 to about 2 liters of water leaves substantially no residual cleaning agents on the surfaces of the medical instruments subsequent to rinsing the instruments, and the concentrate is substantially devoid of a chelating agent.

2. The concentrate of claim 1, wherein the bio-film permeation agent comprises sodium lauryl sulfate.

3. The concentrate of claim 1, wherein the surfactant has an HLB value of about 7.

4. The concentrate of claim 1, further comprising inactive ingredients selected from the group consisting of a fragrance oil, a dye, a foaming agent, a propellant, an anti-foam agent, and water.

5. The concentrate of claim 1, comprising an amount of blue dye sufficient to provide an optically clear wash solution.

6. An aqueous medical instrument cleaning solution comprising from about 6 to about 8 milliliters of the concentrate of claim 1 per from about 0.5 to about 2 liters of water.

7. A medical instrument cleaning concentrate consisting essentially of (i) sodium lauryl sulfate, (ii) a single nonionic alkoxylated alcohol surfactant having an HLB of about 7, wherein a ratio of (i) to (ii) in the concentrate ranges from about 2:1 to about 5:1; and (iii) an amount of blue dye sufficient to provide an optically clear wash solution comprising water and the concentrate, wherein the concentrate is substantially devoid of a chelating agent.

8. A medical instrument wash solution comprising from about 6 to about 8 milliliters of the concentrate of claim 7 per from about 0.5 to about 2 liters of water.

9. The medical instrument wash solution of claim 8, and wherein wash solution leaves no residual cleaning agents on the surfaces of the medical instruments subsequent to rinsing the instruments.

* * * * *